US006672692B2

(12) United States Patent
Weng

(10) Patent No.: US 6,672,692 B2
(45) Date of Patent: Jan. 6, 2004

(54) AUTOMATICALLY RESTORING DEVICE FOR SLIDE RAIL ASSEMBLY

(76) Inventor: Kuo-Chan Weng, No. 196-6, Hsin Chuang Li, Tuku Chen, Yun Lin Hsien (TW)

( * ) Notice: Subject to any disclaimer, the term of this patent is extended or adjusted under 35 U.S.C. 154(b) by 0 days.

(21) Appl. No.: 10/161,697

(22) Filed: Jun. 5, 2002

(65) Prior Publication Data

US 2003/0090186 A1 May 15, 2003

(30) Foreign Application Priority Data

Nov. 14, 2001 (TW) ..... 90219576 U

(51) Int. Cl.[7] ..... A47B 88/00

(52) U.S. Cl. ..... 312/333; 312/334.44; 312/344.46; 312/319.1

(58) Field of Search ..... 312/333, 334.44, 312/344.46, 319.1

(56) References Cited

U.S. PATENT DOCUMENTS 5,207,781 A * 5/1993 Rock ..... 312/319.1
5,302,016 A * 4/1994 Lautenschlager et al. ... 312/333
5,356,207 A * 10/1994 Rock et al. ..... 312/334.46
5,364,179 A * 11/1994 Brustle et al. ..... 312/333
5,580,138 A * 12/1996 Grabher ..... 312/319.1
6,340,078 B1 * 1/2002 Scheible ..... 188/166

* cited by examiner

*Primary Examiner*—Korie Chan
*Assistant Examiner*—Ingrid Weinhold
(74) *Attorney, Agent, or Firm*—Troxell Law Office PLLC

(57) ABSTRACT

Automatically restoring device for slide rail assembly, including a fixed unit, a horizontally slidable receptacle and an automatically restoring section. The fixed unit includes a pair of fixed rails. The horizontally slidable receptacle includes a pair of movable rails. The automatically restoring section is disposed at one end of the fixed rail. One end of each movable rail is formed with a push section. The automatically restoring section includes two slide way bodies, a deflection body and a resilient body. When the push section of the movable rail inward pushes the deflection body, the deflection body is deflected by an angle to engage with and drive the movable rail so as to automatically restore the movable rail to its home position and lock the movable rail therein.

12 Claims, 9 Drawing Sheets

AUTOMATICALLY RESTORING DEVICE FOR SLIDE RAIL ASSEMBLY

BACKGROUND OF THE INVENTION

The present invention is related to an automatically restoring device for slide rail assembly, and more particularly to an automatically restoring device for slide rail assembly composed of slide rails with U-shaped cross-section. The automatically restoring device is able to automatically restore the slide rail assembly to its home position and lock the slide rail assembly in its true position.

Office desks, iron cabinets, file cabinets, tool cabinets, part boxes are generally equipped with drawers. In order to easily draw out or push in the drawer, generally a pair of movable rails with U-shaped cross-section are laid on two sides of the drawer. Correspondingly, a pair of fixed rails with U-shaped cross-section are fixed on the frame body for the drawer to smoothly horizontally slide therealong.

However, practically, some problems often take place as follows:

First, in the case that the drawer is pushed too hard, the drawer will hit the end and then rebound out by a certain distance. Second, in the case that the drawer is pushed in by too little force, the drawer will stop without reaching the end. Accordingly, the drawer cannot be fully closed and will partially protrude from the cabinet body. Third, in the case of inclined ground or earthquake or collision by external force, the drawer will slip out. All the above problems are troublesome and should be solved.

U.S. Pat. No. 5,302,016 discloses an automatically restoring device for slide rail assembly having non-U-shaped cross-section and disposed on bottom face of a drawer. The automatically restoring device includes a base seat with L-shaped slide channel, a hook seat and a spring. The base seat is fixedly disposed on a fixed rail. The hook seat is provided with a projecting post in a direction of normal line. The projecting post is received in the L-shaped slide channel. The hook seat is reciprocally movably locked on the base seat. An engaging mouth extends from one side of the hook seat for engaging with an engaging body disposed on the movable rail. The other side of the hook seat is connected with one end of the spring. The other end of the spring is connected with the base seat. When the engaging body of the movable rail collides and engage with the engaging mouth, the hook seat is deflected and the projecting post slides out of the bending section of the L-shaped slide channel. The spring resiliently pulls the movable rail to its true position.

The above structure has some shortcomings as follows:

1. The bending section of the L-shaped slide channel is not easy to engage with the projecting post of the hook seat in the direction of normal line. Therefore, the automatically restoring device may lose its function.
2. The pulling direction of the spring is different from the central axis of the movable rail so that when driving the movable rail, the transmission efficiency is poor.

The above automatically restoring device is also applicable to the slide rail assembly disposed on lateral side of the drawer and having U-shaped cross-section. In the case that the automatically restoring device is applied to the slide rail assembly composed of three overlapping slide rails with U-shaped cross-section, the base seat is generally attached to the bottom face of one slide rail (such as fixed rail). Accordingly, the base seat will occupy a part of the interior space of the fixed rail. As a result, the length of the movable rail which is not directly fixed on the drawer must be shortened. This minifies the loading ability of the slide rail assembly.

SUMMARY OF THE INVENTION

It is therefore a primary object of the present invention to provide an automatically restoring device for slide rail assembly, which has better transmission effect and is able to automatically restore the movable rail to its home position.

It is a further object of the present invention to provide the above automatically restoring device, which has better freeness of assembly and the loading ability of the slide rail assembly will not be affected.

According to the above objects, the automatically restoring device for slide rail assembly of the present invention includes a fixed unit, a horizontally slidable receptacle and an automatically restoring section. The fixed unit includes a pair of fixed rails. The horizontally slidable receptacle includes a pair of movable rails. The automatically restoring section is disposed at one end of the fixed rail. One end of each movable rail is formed with a push section. The automatically restoring section includes two slide way bodies, a deflection body and a resilient body.

The present invention can be best understood through the following description and accompanying drawings wherein:

DETAILED DESCRIPTION OF THE PREFERRED EMBODIMENTS

Figure 1:
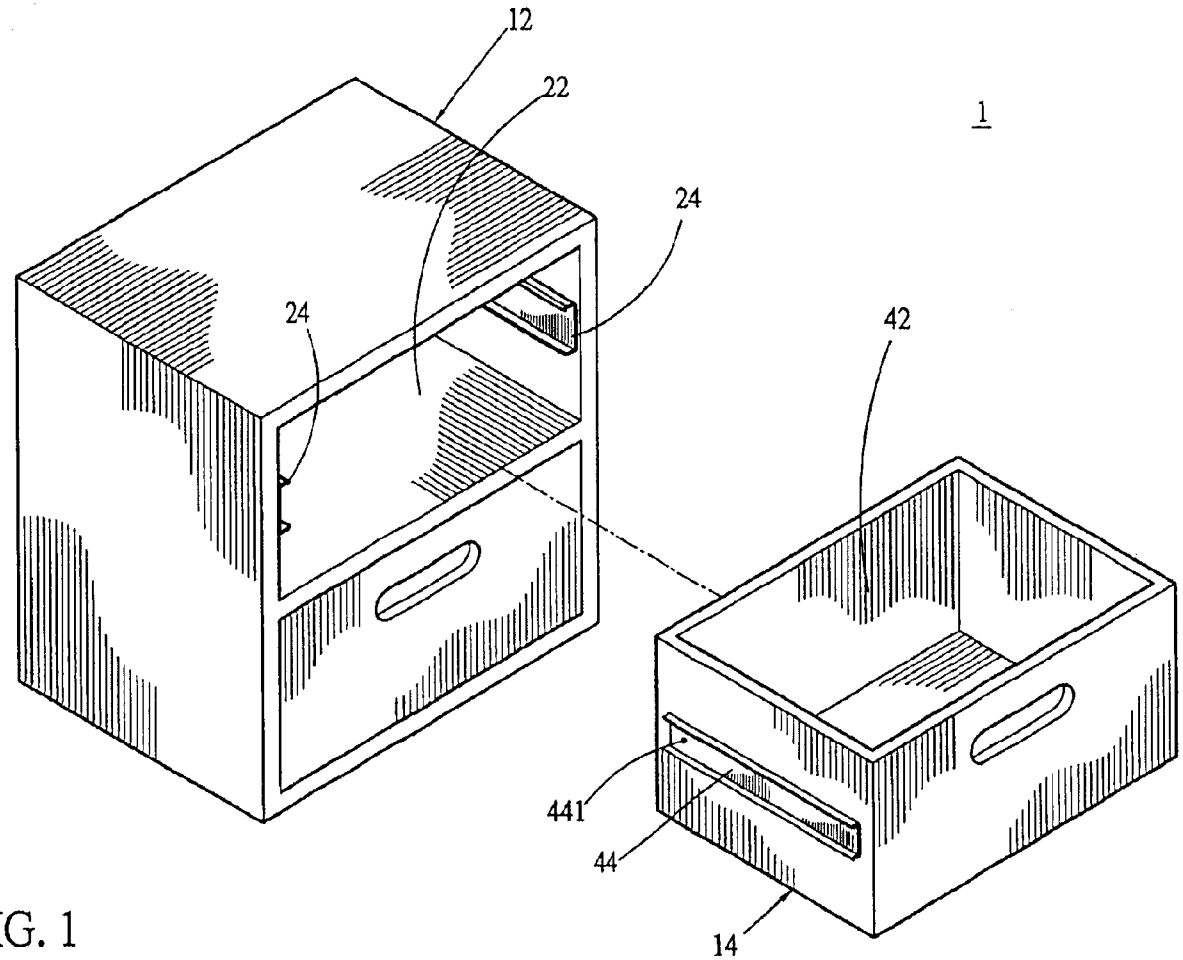
FIG. 1 is a perspective view of a cabinet and drawers to which the present invention is applied.
Figure 2:
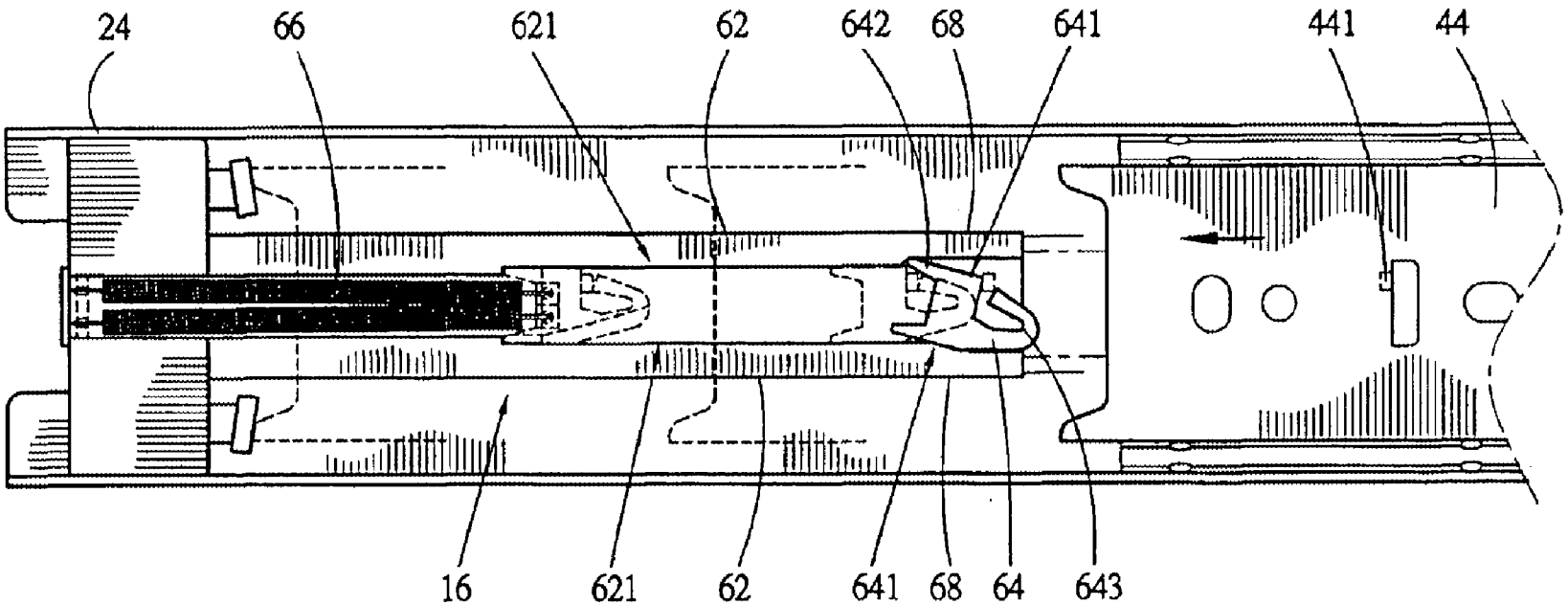
FIG. 2 shows the operation of a first embodiment of the slide rail assembly of the present invention.

Please refer to FIGS. 1 and 2. The automatically restoring device 1 for slide rail assembly of the present invention includes a fixed unit 12, a horizontally slidable receptacle 14 and an automatically restoring section 16.

The fixed unit 12 defining an interior space 22. A pair of substantially parallel fixed rails 24 are mounted on two inner sides of the interior space 22.

The horizontally slidable receptacle 14 has a receiving section 42. A pair of movable rails 44 are disposed on two outer sides of the receiving section 42 corresponding to the fixed rails 24, whereby the horizontally slidable receptacle 14 can be drawn out of the fixed unit 12 or pushed thereinto.

One end of each movable rail 44 is formed with a push section 441.

The automatically restoring section 16 is disposed at one end of each fixed rail 24. The automatically restoring section 16 includes two slide way bodies 62, a deflection body 64 and a resilient body 66.

Each slide way body 62 is a rectangular body with a predetermined length. A lateral face of the slide way body 62 is formed with a first slide section 621. One end of the slide way body 62 is fixed on the fixed rail 24. The first slide sections 621 of the slide way bodies 62 face each other and are spaced from each other by a predetermined distance. The other end of the slide way body 62 has an outward extending sub-slide way body 68 with a predetermined length. The maximum distance between the opposite faces of the sub-slide way bodies 68 is larger than the maximum distance between the opposite faces of the slide way bodies 62. Accordingly, the inner edges of the two slide way bodies 62 and the outward extending sub-slide way bodies 68 define a trumpet-shaped opening.

The deflection body 64 is a substantially rectangular body. The width of the deflection body 64 corresponds to the distance between the two slide way bodies 62. Two lateral faces of the deflection body 64 are respectively formed with two second slide sections 641. The first and second slide sections 621, 641 are engaged with each other, whereby the deflection body is slidably positioned between the two slide way bodies 62. The deflection body 64 further includes an abutting section 642 and a latch section 643.

The abutting section 642 is formed of a projecting leg extending from one side of the deflection body 64 toward the fixed end of the slide way body 62 fixed on the fixed rail 24. The abutting section 642 has a predetermined length.

The latch section 643 is a bending hook body outward extending from one side of the deflection body 64 opposite to the abutting section 642.

Two ends of the resilient body 66 are respectively connected with the deflection body 64 and the fixed end of the slide way body 62 fixed on the fixed rail 24.

The deflection body 64 is slidably positioned between the two slide way bodies 62 and the two sub-slide way bodies 68. When the deflection body 64 is positioned between the two sub-slide way bodies 68, the deflection body 64 will swing to make the abutting section 642 abut against the adjoining sections of one slide way body 62 and sub-slide way body 68. By means of the pulling force of the resilient body 66, the deflection body 64 is fixed between the two sub-slide way bodies 68. When the movable rail 44 is moved to a position where the push section 441 collide the deflection body 64, the deflection body 64 is swung, whereby the abutting section 642 no more abuts against the adjoining sections. At the same time, the latch section 643 hooks and latches the push section 441. By means of the pulling force of the resilient body 66, the deflection body 64 drives the movable rail 44 to further move so as to automatically restore the movable rail 44 to its true position.

The automatically restoring device 1 for slide rail assembly of the present invention has the following advantages:

1. The abutting section 642 abuts against the adjoining sections by way of insertion so that the engaging effect is better. In case of unexpected external force, the deflection body 64 is not easy to jump away. Therefore, the automatically restoring function is ensured.
2. The direction of the pulling force of the resilient body 66 substantially coincides with the central axis of the movable rail 44 so that the transmission efficiency is better.

Figure 3:
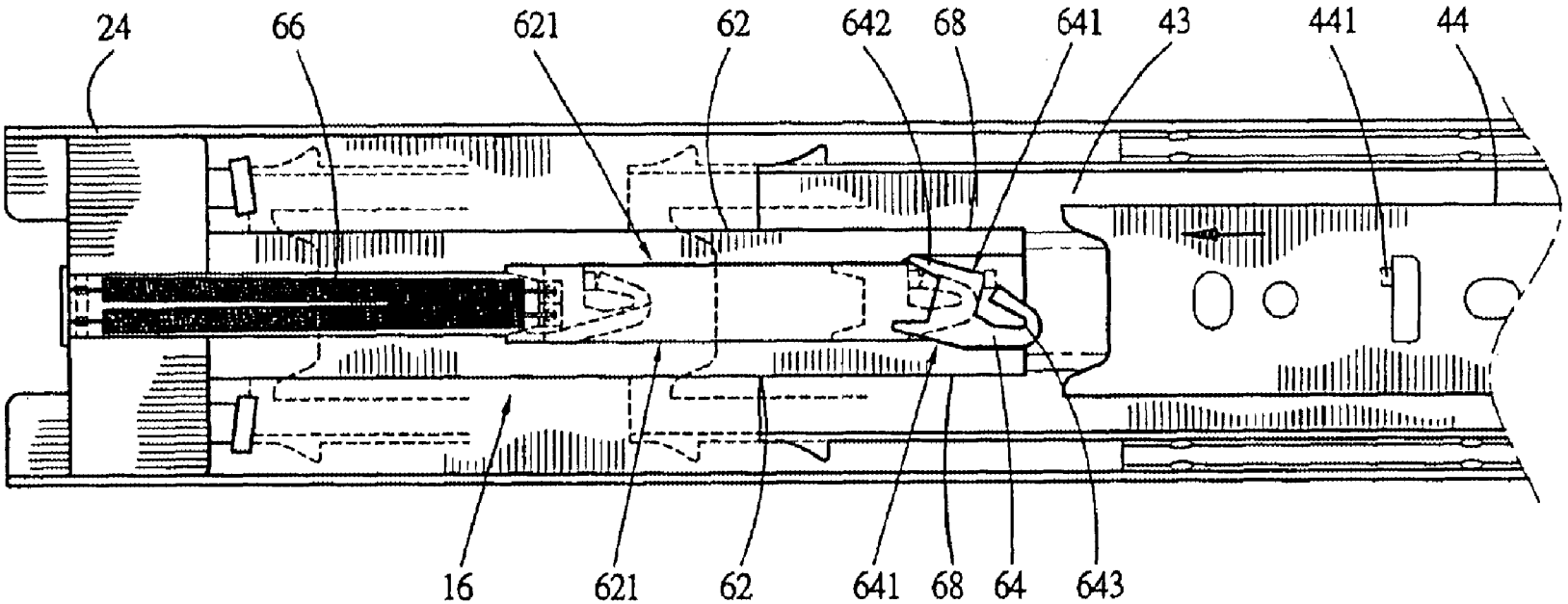
FIG. 3 shows the operation of a second embodiment of the slide rail assembly of the present invention.
Figure 4:
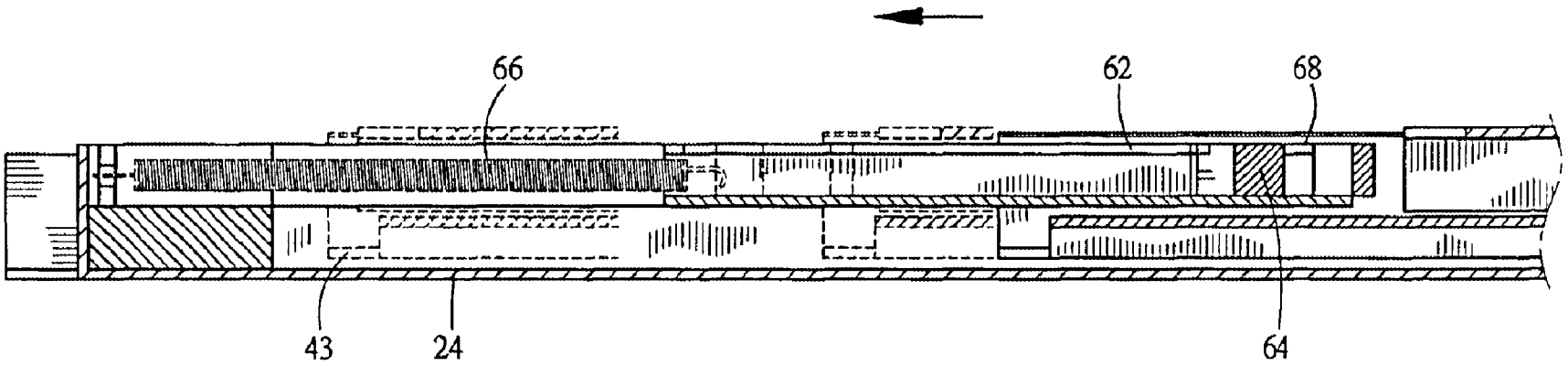
FIG. 4 is a lengthwise sectional view according to FIG. 3.

Referring to FIG. 3, a sub-movable rail 43 is further disposed between the fixed rail 24 and the movable rail 44. The sub-movable rail 43 cooperates with the horizontally slidable receptacle 14 to achieve longer length. Furthermore, referring to FIG. 4, the two slide way bodies 62 and the extending sub-slide way bodies 68 are disposed in form of cantilever. Therefore, the sub-movable rail 43 can extend between the two slide way bodies 62 and the fixed rail 24. Therefore, the length of the sub-movable rail 43 is increased so that the slide rail assembly of the present invention has better loading ability.

Figure 5:
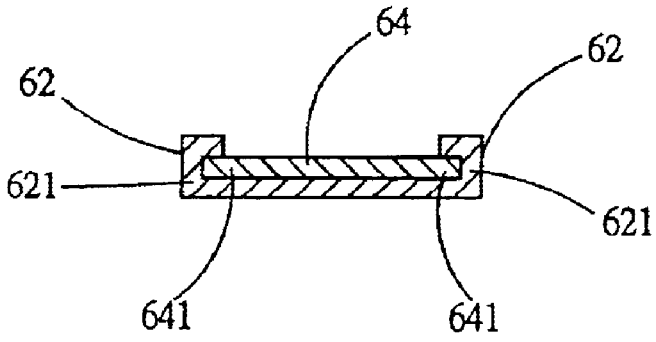
FIG. 5 is a cross-sectional view of the assembly of a deflection body and slide way body of the present invention.

Referring to FIG. 5, the first slide section 621 is a channel having a bottom face and two lateral faces. The shape of outer edge of the second slide section 641 corresponds to the shape of inner edge of the first slide section 621.

Figure 6:
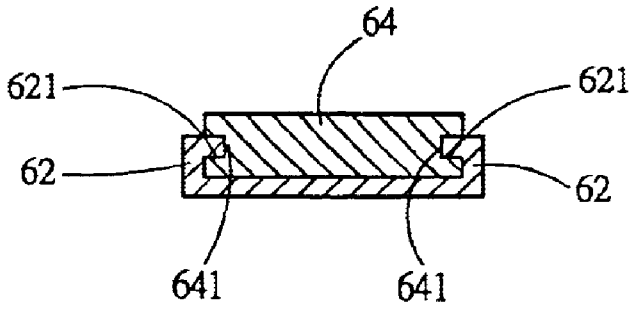
FIG. 6 is a cross-sectional view of the assembly of another deflection body and slide way body of the present invention.

Referring to FIG. 6, the second slide section 641 is a channel having a bottom face and two lateral faces. The shape of outer edge of the first slide section 621 corresponds to the shape of inner edge of the second slide section 641.

The resilient body is a coiled spring.

The fixed rail 24, movable rail 44 and the sub-movable rail 43 are channel bodies each having a bottom face and two lateral faces.

Figure 7:
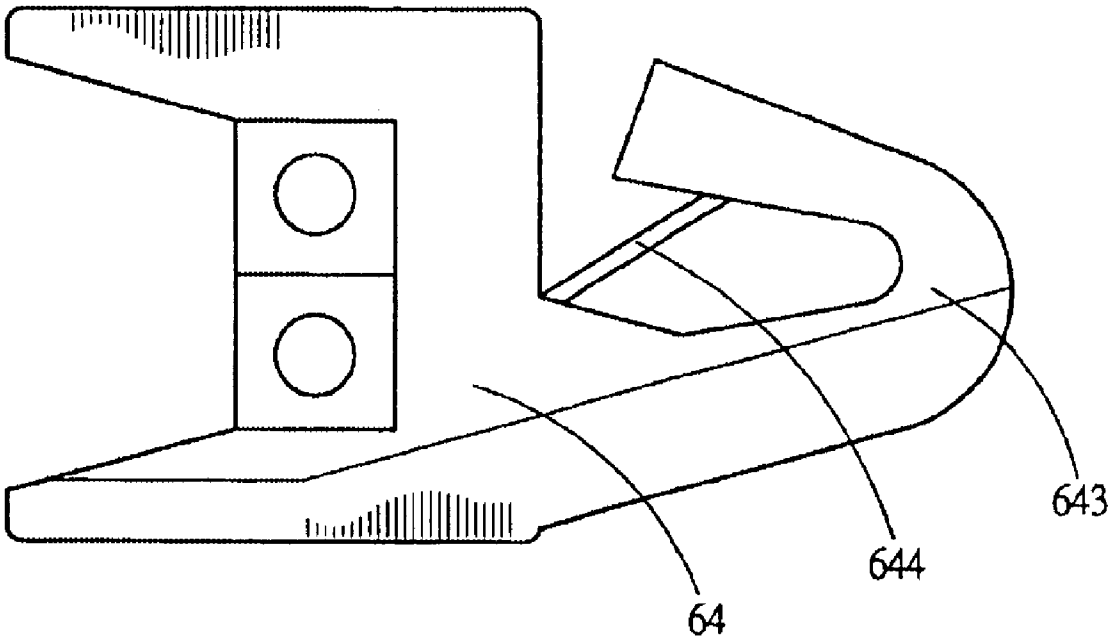
FIG. 7 is a front view showing that a connecting section is disposed between the deflection body and the latch section of the present invention.

Referring to FIG. 7, a connecting section 644 is further disposed between the deflection body 64 and the latch section 643 for connecting the deflection body 64 with the latch section 643. When the latch section 643 suffers a force, the latch section 643 is reinforced without being easily damaged.

Figure 8:
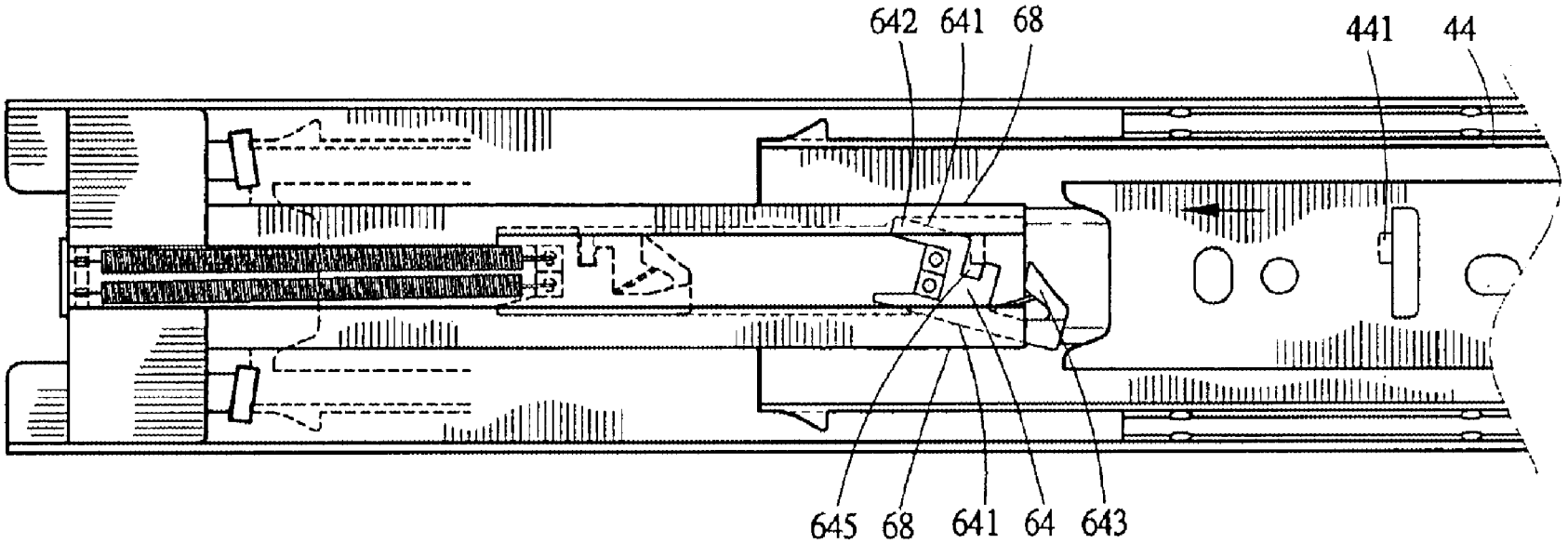
FIG. 8 shows the operation of a third embodiment of the slide rail assembly of the present invention.
Figure 9:
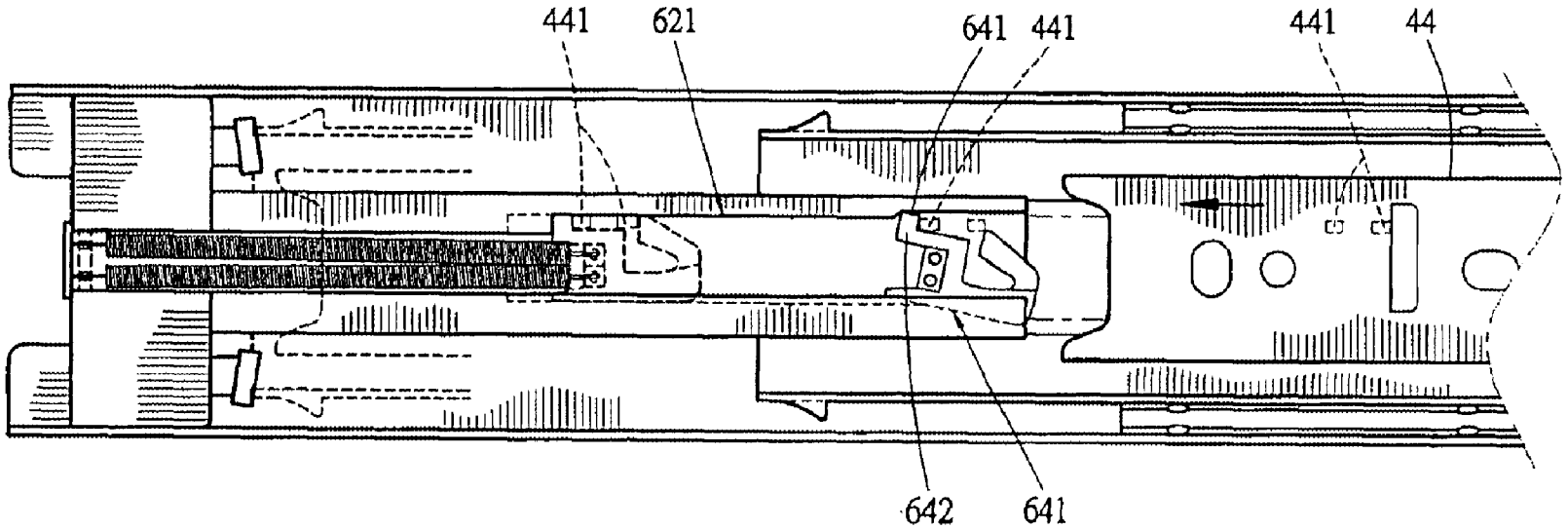
FIG. 9 shows the side view of the operation of a third embodiment of the slide rail assembly of the present invention.

Referring to FIGS. 8 and 9, the deflection body 64 further includes an engaging section 645 which is formed of a notch disposed between the abutting section 642 and the latch section 643. The notch has an opening facing upward (according to FIG. 8). The push section 441 is mainly engaged with the engaging section 645 for driving the movable rail 44. Instead, the latch section 643 becomes an insurance means. In case that the deflection body 64 is shocked by unexpected external force and leaves the positioned in the sub-slide way body 68, while failing to engage with and drive the movable rail 44, the push section 441 can be further forwarded relative to the latch section 643 through an excessive travel and then hooked and latched by the latch section 643. At this time, it is unnecessary to detach the present invention and the deflection body 64 can be brought back to the position in the sub-slide way body 68 to recover the function.

Figure 10:
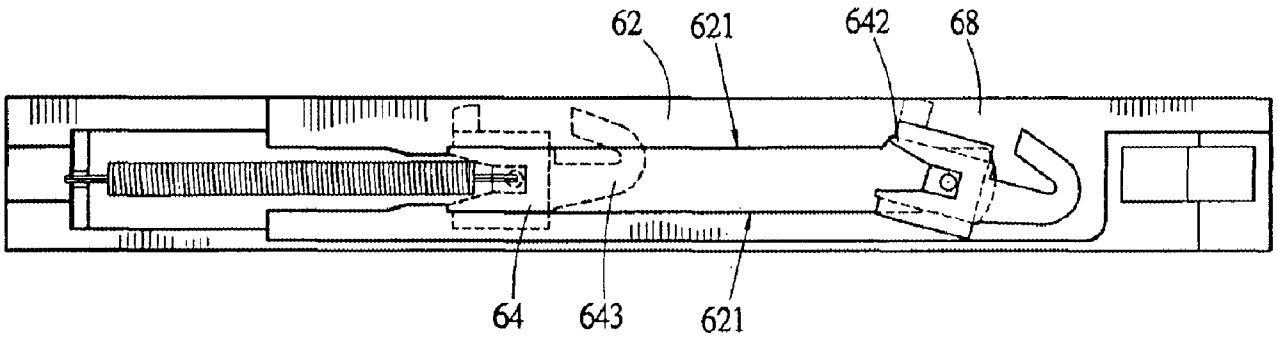
FIG. 10 shows the automatically restoring section of a fourth embodiment of the present invention.

Referring to FIG. 10, in the second and third embodiments, two push sections 441 are arranged on the movable rail 44 at an interval in moving direction of the movable rail 44. When the movable rail 44 is mounted in the horizontal slidable receptacle 14, a better freeness of assembly is achieved.

Figure 11:
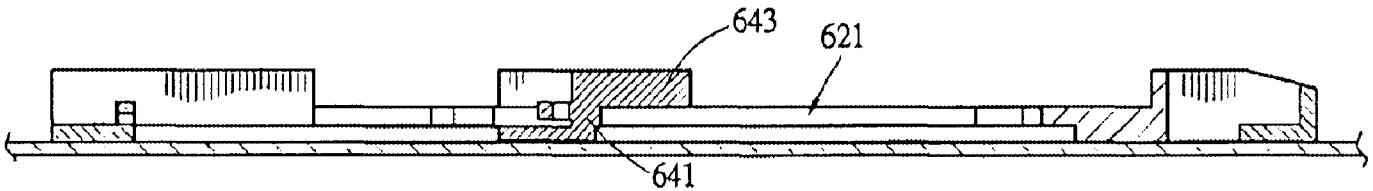
FIG. 11 shows the automatically restoring section of a fifth embodiment.

Referring to FIG. 11, the slide way body 62 and the sub-slide way body 68 are integrally connected to form a horizontal panel. The middle section of the horizontal panel is hollowed to form the first slide section 621. The inner edge of one end of the first slide section 621 is trumpet-shaped. In addition, the second slide sections 641 on two lateral faces of the deflection body 64 are channels each having a bottom face and two lateral faces for connecting with the first slide section 621.

The above embodiments are only used to illustrate the present invention, not intended to limit the scope thereof.

Many modifications of the above embodiments can be made without departing from the spirit of the present invention.

What is claimed is:

1. Automatically restoring device for slide rail assembly, comprising:

a fixed unit defining an interior space, a pair of substantially parallel fixed rails being mounted on two inner sides of the interior space; and a horizontally slidable receptacle having a receiving section, a pair of movable rails being disposed on two outer sides of the receiving section corresponding to the fixed rails, whereby the horizontally slidable receptacle can be drawn out of the fixed unit or pushed thereinto, said automatically restoring device being characterized in that:

one end of each movable rail is formed with a push section;

an automatically restoring section is disposed at one end of the fixed rail, the automatically restoring section including two slide way bodies, a deflection body and a resilient body;

each slide way body is a rectangular body with a predetermined length, a lateral face of the slide way body being formed with a first slide section, one end of the slide way body being fixed on the fixed rail, the first slide sections of the slide way bodies facing each other and being spaced from each other by a predetermined distance, the other end of the slide way body having an outward extending sub-slide way body with a predetermined length, the maximum distance between the opposite faces of the sub-slide way bodies being larger than the maximum distance between the opposite faces of the slide way bodies, whereby the inner edges of the two slide way bodies and the outward extending sub-slide way bodies define a trumpet-shaped opening;

the deflection body is a substantially rectangular body, the width of the deflection body corresponding to the distance between the two slide way bodies, two lateral faces of the deflection body being respectively formed with two second slide sections, the first and second slide sections being engaged with each other, whereby the deflection body is slidably positioned between the two slide way bodies, the deflection body further including an abutting section and a latch section;

the abutting section is formed of a projecting leg extending from one side of the deflection body toward the fixed end of the slide way body fixed on the fixed rail, the abutting section having a predetermined length;

the latch section is a bending hook body outward extending from one side of the deflection body opposite to the abutting section;

two ends of the resilient body are respectively connected with the deflection body and the fixed end of the slide way body fixed on the fixed rail; and the deflection body is slidably positioned between the two slide way bodies and the two sub-slide way bodies, whereby when the deflection body is positioned between the two sub-slide way bodies, the deflection body will swing to make the abutting section abut against the adjoining sections of one slide way body and sub-slide way body, by means of the pulling force of the resilient body, the deflection body being fixed between the two sub-slide way bodies, when the movable rail is moved to a position where the push section collide the deflection body, the deflection body being swung, whereby the abutting section no more abuts against the adjoining sections, at this time, the latch section hooking and latching the push section, by means of the pulling force of the resilient body, the deflection body driving the movable rail to further move so as to automatically restore the movable rail to its home position.

2. Automatically restoring device for slide rail assembly as claimed in claim 1, wherein a sub-movable rail is further disposed between the fixed rail and the movable rail.

3. Automatically restoring device for slide rail assembly as claimed in claim 2, wherein the two slide way bodies and the extending sub-slide way bodies are disposed in form of cantilever, whereby the sub-movable rail can extend between the two slide way bodies and the fixed rail to elongate the length of the sub-movable rail so that the slide rail assembly has better loading ability.

4. Automatically restoring device for slide rail assembly as claimed in claim 1, wherein the first slide section is a channel having a bottom face and two lateral faces, the shape of outer edge of the second slide section corresponding to the shape of inner edge of the first slide section.

5. Automatically restoring device for slide rail assembly as claimed in claim 1, wherein the second slide section is a channel having a bottom face and two lateral faces, the shape of outer edge of the first slide section corresponding to the shape of inner edge of the second slide section.

6. Automatically restoring device for slide rail assembly as claimed in claim 1, wherein the resilient body is a coiled spring.

7. Automatically restoring device for slide rail assembly as claimed in claim 1, wherein the fixed rail and the movable rail are channel bodies each having a bottom face and two lateral faces.

8. Automatically restoring device for slide rail assembly as claimed in claim 2, wherein the fixed rail, movable rail and the sub-movable rail are channel bodies each having a bottom face and two lateral faces.

9. Automatically restoring device for slide rail assembly as claimed in claim 1, wherein a connecting section is further disposed between the deflection body and the latch section for connecting the deflection body with the latch section.

10. Automatically restoring device for slide rail assembly as claimed in claim 1, wherein the deflection body further includes an engaging section which is formed of a notch disposed between the abutting section and the latch section.

11. Automatically restoring device for slide rail assembly as claimed in claim 1, wherein two push sections are arranged on the movable rail at an interval in moving direction of the movable rail.

12. Automatically restoring device for slide rail assembly as claimed in claim 1, wherein the slide way body and the sub-slide way body are integrally connected to form a horizontal panel, a middle section of the horizontal panel being hollowed to form the first slide section, the inner edge of one end of the first slide section being trumpet-shaped, the second slide sections on two lateral faces of the deflection body being channels each having a bottom face and two lateral faces for connecting with the first slide section.

* * * * *